US008419166B2

(12) United States Patent
Tsukamoto

(10) Patent No.: US 8,419,166 B2
(45) Date of Patent: Apr. 16, 2013

(54) LIQUID DISCHARGE RECORDING HEAD

(75) Inventor: Naoya Tsukamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 266 days.

(21) Appl. No.: 12/778,865

(22) Filed: May 12, 2010

(65) Prior Publication Data

US 2010/0302316 A1 Dec. 2, 2010

(30) Foreign Application Priority Data

May 28, 2009 (JP) ..... 2009-128789

(51) Int. Cl.
*B41J 2/14* (2006.01)
*B41J 2/16* (2006.01)

(52) U.S. Cl.
USPC ..... 347/50

(58) Field of Classification Search ..... None
See application file for complete search history.

(56) References Cited

U.S. PATENT DOCUMENTS 7,152,957 B2 * 12/2006 Mori ..... 347/50
2006/0139410 A1 * 6/2006 Kawamura et al. ..... 347/58
2007/0006459 A1 * 1/2007 Ono et al. ..... 29/890.1
2007/0139469 A1 * 6/2007 Yasuda et al. ..... 347/42

FOREIGN PATENT DOCUMENTS

JP 2001-130001 5/2001
JP 2007-055221 3/2007

* cited by examiner

*Primary Examiner* — Matthew Luu
*Assistant Examiner* — Renee I Wilson
(74) *Attorney, Agent, or Firm* — Canon USA Inc IP Division

(57) ABSTRACT

The liquid jet recording head includes a recording element substrate provided with a discharge port, and an electrode portion receiving a signal for controlling the discharge of the liquid droplet from the discharge port; a flexible wiring member provided with an opening, a flying lead protruding from the peripheral edge of the opening, and a film covering a portion of the flying lead; a sealant covering an electrical connection between the electrode portion and the flying lead; and a supporting member to which the recording element substrate and the flexible wiring member are attached. The film overhangs along the extension direction of the flying lead to the recording element substrate from the peripheral edge of the opening to form a void between the side surface of the recording element substrate and the supporting member, thereby partitioning the void from the electrical connection.

7 Claims, 8 Drawing Sheets

LIQUID DISCHARGE RECORDING HEAD

BACKGROUND OF THE INVENTION

1. Field of the Invention

The present invention relates to a liquid discharge recording head included in a liquid discharge type recording apparatus.

2. Description of the Related Art

A liquid discharge type recording apparatus represented by an ink jet printer is provided with a liquid discharge recording head which discharges liquid droplets. FIGS. 8A and 8B are views illustrating the configuration of essential parts of a conventional liquid discharge recording head 200, FIG. 8A is an enlarged view of a seal part, and FIG. 8B is the sectional view taken along a section line 8B-8B illustrated in FIG. 8A. In the liquid discharge recording head 200, a recording element substrate 210 and a flexible wiring member 230 are attached to a supporting member 250. Discharge ports 211 (refer to FIG. 8A) and an electrode portion 212 are provided in close proximity with each other in the recording element substrate 210. The flexible wiring member 230 is provided with an opening 231 for allowing the recording element substrate 210 to be exposed therethrough, and a flying lead 232 electrically connected to the electrode portion 212. In the liquid discharge recording head 200, a void provided between the side surface of the recording element substrate 210, and the supporting member 250, i.e., the rear side of the flying lead 232 is filled with first sealant 221 with relatively low viscosity and flexibility. Additionally, an electrical connection that is a connection between the electrode portion 212 and the flying lead 232 is covered with second sealant 222 which has relatively high viscosity and has rigidity against an external force (refer to FIG. 8B). This protects the electrical connection from corrosion caused by ink and an external force (Japanese Patent Application Laid-Open No. 2001-130001). However, in the liquid discharge recording head 200, two kinds of sealants with different characteristics according to the difference between seal parts are used, which will cause an increase in material cost. Thus, a liquid discharge recording head for solving such a problem is suggested, and is disclosed in Japanese Patent Application Laid-Open No. 2007-055221.

FIGS. 9A and 9B are views illustrating the configuration of a liquid discharge recording head 100 described in Japanese Patent Application Laid-Open No. 2007-055221, FIG. 9A is a plan view illustrating the configuration of essential parts of the liquid discharge recording head 100, and FIG. 9B is a sectional view taken along a section line 9B-9B illustrated in FIG. 9A. In the liquid discharge recording head 100, a recording element substrate 110 and a flexible wiring member 130 are attached to a supporting member 150. Discharge ports 111 and an electrode portion 113 are provided adjacent to each other in the recording element substrate 110. The flexible wiring member 130 is provided with a flying lead 132, a device hole 134 for allowing the discharge ports 111 to be exposed therethrough, and a bonding hole 135 for allowing an electrical connection 114 to be exposed therethrough. A void (the rear side of the flying lead 132) provided between the recording element substrate 110 and the supporting member 150 is filled with sealant 121 with low viscosity and high fluidity. The electrical connection 114 that is a connection between the flying lead 132 and an electrode terminal 113 is covered with sealant 122. Since the bonding hole 135 and the device hole 134 are provided independently from each other when the sealant 122 is applied, the sealant 122 is dammed at the peripheral edge of the bonding hole 135 (refer to FIG. 9B).

Therefore, even if the sealant 122 has the same low viscosity as the sealant 121 and has a high fluidity, the outflow of the sealant 122 to the discharge ports 111 can be prevented. Accordingly, sealing can be made only by one kind of sealant.

In the liquid discharge recording head, a reduction in the materials to be used is required for further cost reduction. However, in the liquid discharge recording head 100, in order to reliably seal the electrical connection 114 with sealant, an amount of sealant to fill the void provided between the side surface of the recording element substrate 110 and the supporting member 150 is needed. Accordingly, there is a danger that the sealing will become insufficient by simply reducing the amount of the sealant to be used.

SUMMARY OF THE INVENTION

The object of the present invention is to provide a liquid discharge recording head capable of achieving reliable sealing with a small amount of sealant.

The liquid jet recording head according to the present invention for achieving the above object includes a recording element substrate provided with a discharge port through which a liquid droplet is discharged, and an electrode portion which receives a signal for controlling the discharge of the liquid droplet from the discharge port; a flexible wiring member provided with an opening through which the recording element substrate is exposed, a flying lead which protrudes from the peripheral edge of the opening so as to be connected to the electrode portion and transmit the signal to the electrode portion, and a film which covers a portion of the flying lead; sealant which covers an electrical connection that is a connection between the electrode portion and the flying lead; and a supporting member to which the recording element substrate and the flexible wiring member are attached.

Here, the film overhangs along the extension direction of the flying lead to the recording element substrate from the peripheral edge of the opening so as to form a void between the side surface of the recording element substrate, and the supporting member, thereby partitioning the void from the electrical connection.

According to the present invention, since the void provided between the side surface of the recording element and the supporting member is partitioned from the electrical connection by the cover film, when the electrical connection is sealed, filling sealant into the void becomes unnecessary. Hence, it is possible to reliably perform sealing with a smaller amount of sealant.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, embodiments of the present invention will be described with reference to the drawings. In addition, the liquid discharge recording head of the present invention can be mounted on a liquid discharge type recording apparatus, such as a printer, a word processor, a facsimile, and a copying machine.

Figure 1A:
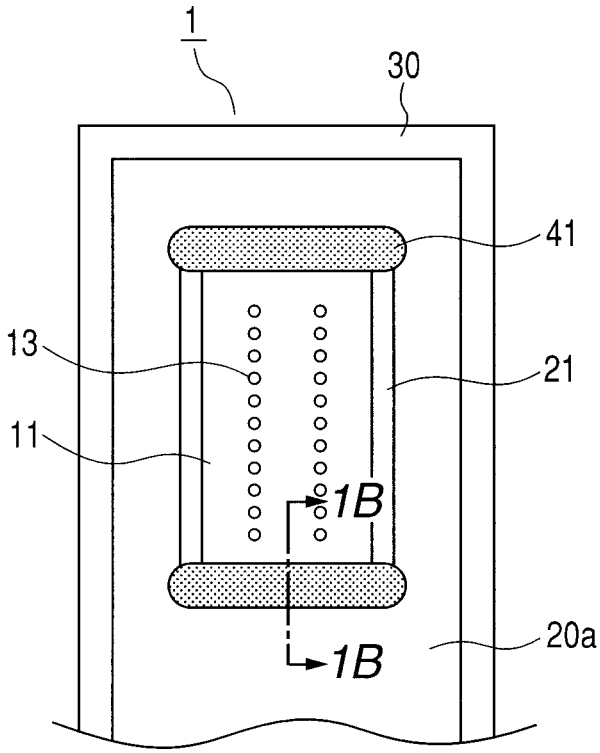
FIGS. 1A and 1B are views illustrating the configuration of essential parts of a liquid discharge recording head of Embodiment 1.
Figure 1B:
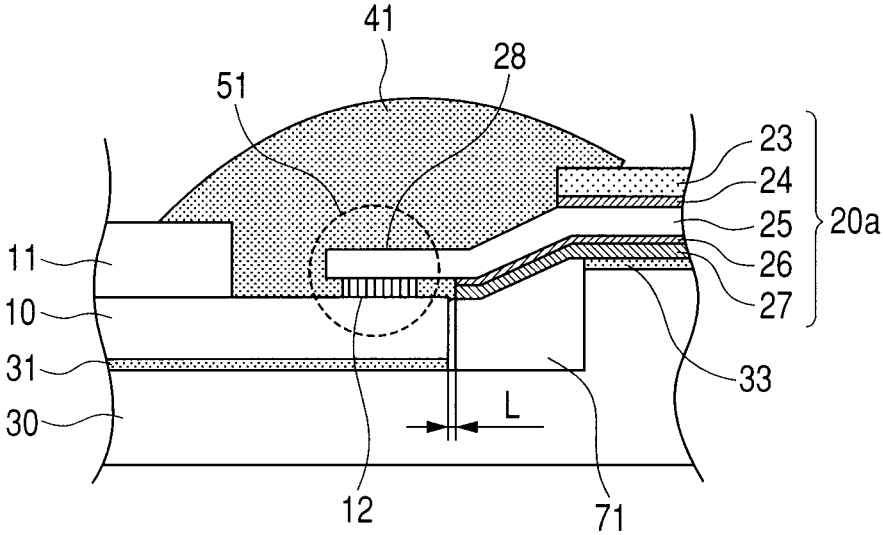
Figure 2:
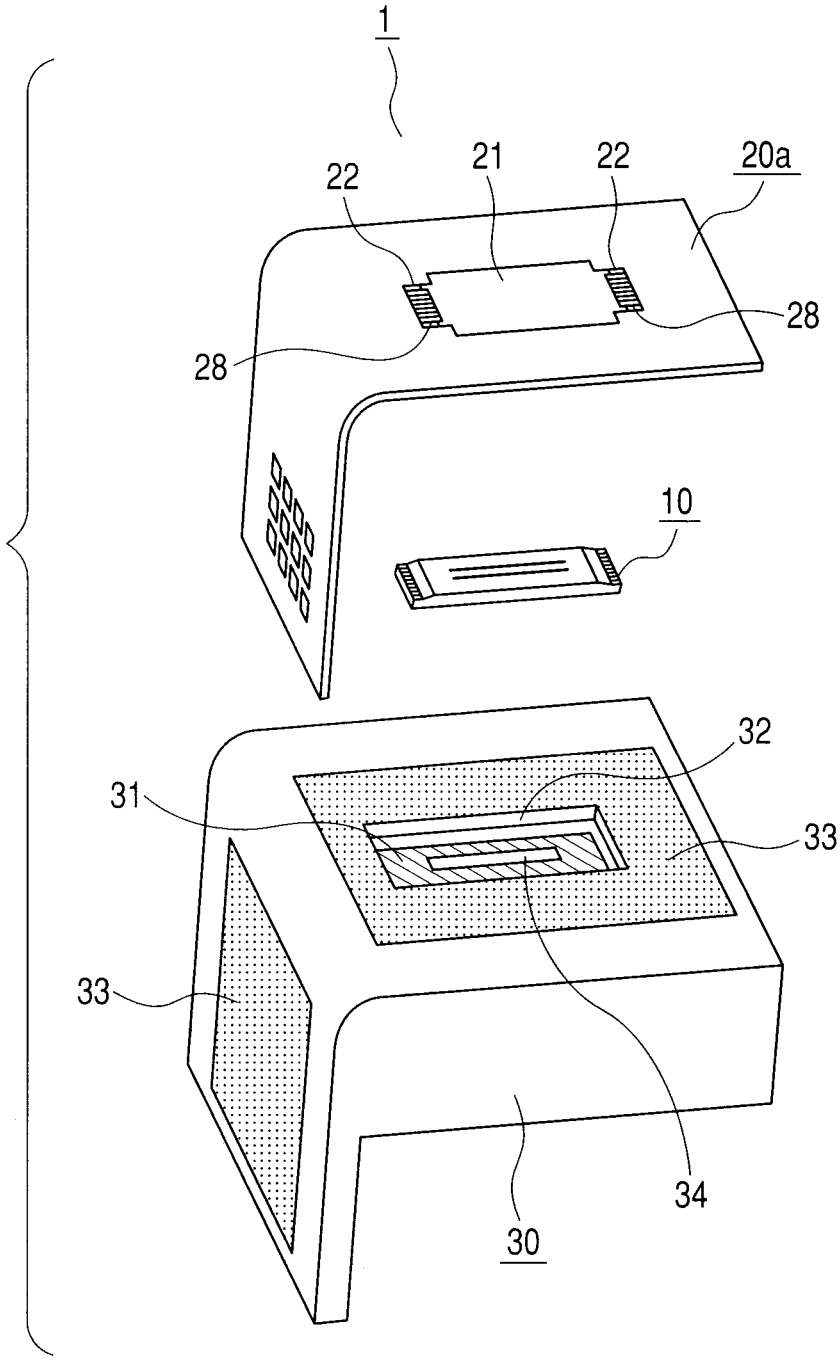
FIG. 2 is a perspective view illustrating a state where the liquid discharge recording head of Embodiment 1 is disassembled.

FIGS. 1A and 1B are views illustrating the configuration of essential parts of a liquid discharge recording head of Embodiment 1, FIG. 1A is a plan view illustrating the configuration of essential parts of the liquid discharge recording head 1, and FIG. 1B is a sectional view taken along a section line 1B-1B of FIG. 1A. Additionally, FIG. 2 is a perspective view illustrating a state where the liquid discharge recording head 1 is disassembled.

In the liquid discharge recording head 1, a recording element substrate 10 and a flexible wiring member 20*a* are attached to a supporting member 30. Specifically, as illustrated in FIG. 2, the recording element substrate 10 is fixed to a recess 32 of the supporting member 30 by an adhesive 31, and the flexible wiring member 20*a* is fixed to the supporting member 30 by an adhesive 33. Additionally, the recording element substrate 10 is fixed to the supporting member 30 in a state where the substrate is exposed through a device hole 21 and a bonding hole 22 that are openings provided in the flexible wiring member 20*a*.

The supporting member 30 is formed with an ink flow passage 34 for supplying ink to the recording element substrate 10. After an ink supply port (not illustrated) of the recording element substrate 10 is positioned so as to correspond to the ink flow passage 34, the recording element substrate 10 is fixed. At this time, as illustrated in FIG. 1B, a void 71 is provided between the side surface of the recording element substrate 10, and the supporting member 30.

The recording element substrate 10, as illustrated in FIGS. 1A and 1B, includes a nozzle plate 11, an electrode portion 12, and an energy generation unit (not illustrated). Discharge ports 13 through which liquid droplets are discharged are provided in the nozzle plate 11 so as to face the device hole 21. Additionally, the electrode portion 12 is provided adjacent to the discharge ports 13 so as to face the bonding hole 22. In the recording element substrate 10, as the electrode portion 12 receives a signal for controlling the discharge of a liquid droplet and the energy generation unit gives energy to liquid (ink) based on this signal, the liquid droplet is discharged from a discharge port 13.

Figure 3A:
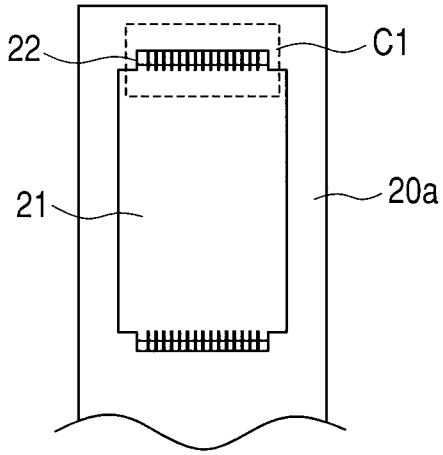
FIGS. 3A, 3B and 3C are views for describing the structure of a flexible wiring member.
Figure 3B:
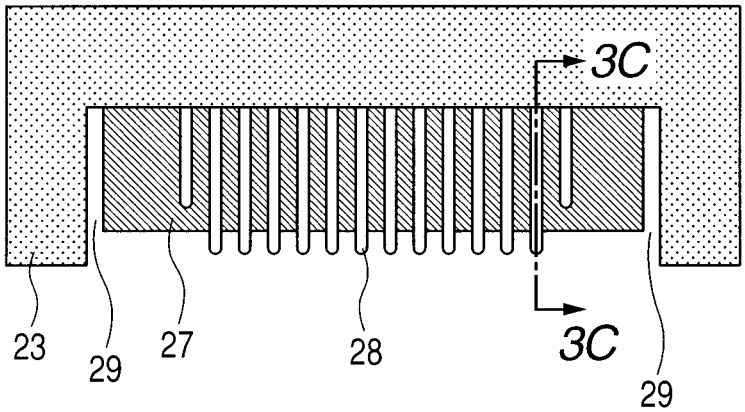
Figure 3C:
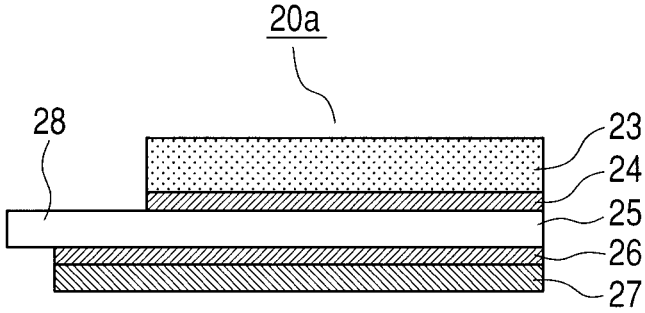

FIGS. 3A to 3C are views for describing the structure of the flexible wiring member 20*a*. FIG. 3A is a plan view of the flexible wiring member 20*a*, FIG. 3B is an enlarged view of a region C1 illustrated in FIG. 3A, and FIG. 3C is the sectional view taken along a section line 3C-3C illustrated in FIG. 3B.

As illustrated in FIG. 3C, the flexible wiring member 20*a* has a laminate in which a base film 23, a wiring member 25, and a cover film 27 are laminated. In this laminate, the base film 23 is made of insulating resin, such as upilex and kapton, and the wiring member 25 is bonded on the rear surface of the base film with an adhesive 24. The wiring member 25 is flat and plate-like, and includes a plurality of circuit patterns. This circuit pattern is formed by bonding a metallic foil made of a conductive material, such as copper foil, on the rear surface of a base film 23 and patterning a desired shape using photolithography. Plating of gold or tin is performed on the metallic foil (flat plate-like wiring member 25) after the patterning. A portion which does not expose a metal surface is covered with the cover film 27, such as a resist layer, using an adhesive 26.

The flying lead 28 that is a portion of the wiring member 25, and protrudes from the peripheral edge of the bonding hole 22 is formed by plating nickel as a diffusion-preventing layer on wiring mainly including copper, and finally plating gold on the layer. As illustrated in FIG. 3C, the surface of the flying lead 28 facing the void 71, i.e., the rear surface of the flying lead 28, is covered with the cover film 27 except for a tip portion. The cover film 27 overhangs to a position adjacent to the recording element substrate 10 along the rear surface of the flying lead 28 from the peripheral edge of the bonding hole 22.

In addition, as in FIG. 3B, a slit 29 may be provided along the flying lead 28 in the cover film 27. The slit 29 is provided for reducing the shape restoring force of the cover film 27 which works in a direction in which the connection between the electrode portion 12 and the flying lead 28 is pulled apart. Thereby, the connection between the electrode portion 12 and the flying lead 28 is strengthened, and the signal transmission to the electrode portion 12 from the flying lead 28 is reliably performed. Additionally, the electrode portion 12 and the flying lead 28 are connected together by an Au—Au bond according to a gang bonding method. Therefore, it is desirable that the shape restoring force of the cover film 27 is smaller than the pull strength (joining force) of an electrical connection 51 that is a connection between the flying lead 28 and the electrode portion 12.

After the electrode portion 12 and the flying lead 28 are connected together, sealant 41 is applied so as to cover the surfaces of the electrical connection 51 and the flying lead 28. At this time, since the void 71 is partitioned from the electrical connection 51 by the cover film 27, sealant which has flowed out to between the electrical connection 51 and the peripheral edge of the bonding hole 135 is supported by the cover film 27. Therefore, when the electrical connection 51 is sealed, it is not necessary to fill the void 71 with the sealant 41. Accordingly, it is possible to reliably perform sealing with a smaller amount of sealant than ever before. If the amount of sealant to be used can be reduced, it is possible to shorten the time required for filling the sealant, i.e., the time required for a sealing process. Additionally, although the sealant is generally cured by heating, a stress is generated during heating and cooling. Since this stress may affect the recording element substrate, the amount of the sealant to be applied can be smaller. Especially, the amount of sealant to be applied to the side surface of the recording element substrate can be reduced by the configuration of the present application. Thus, it is preferable in that the effect of stress can be alleviated.

In addition, in the liquid discharge recording head 1, if the cover film 27 is formed with the slit 29, the sealant 41 needs to have such viscosity that the sealant does not flow out of the slit 29.

Additionally, if the recording element substrate 10 and the cover film 27 are not in contact, the value of the distance L (refer to FIG. 1B) therebetween may be suitably determined in a range where the sealant 41 does not flow out of between the cover film 27 and the recording element substrates 10.

Figure 4:
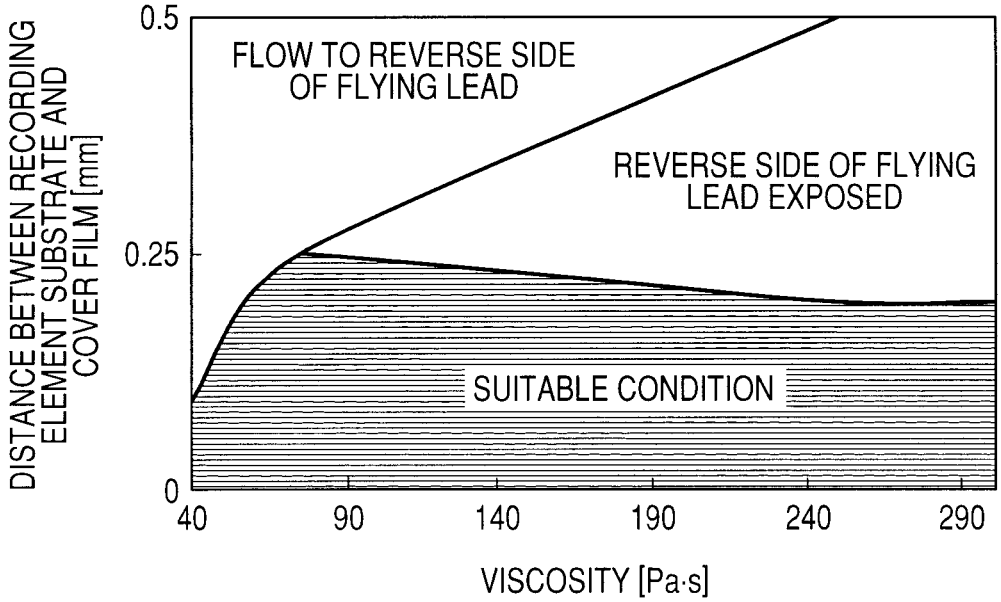
FIG. 4 is a graph illustrating the relationship between the distance between a recording element and a cover film, and the viscosity of sealant.

FIG. 4 is a graph illustrating the relationship between the distance L between the recording element substrate 10 and the cover film 27, and the viscosity of the sealant 41. As illustrated in FIG. 4, if the viscosity was equal to or higher than 55 Pa·s, even if the distance L was 0.1 mm, a phenomenon in which the surface of the flying lead 28 is exposed did not occur. Additionally, if the distance L was equal to or more than 0.2 mm, exposure occurred in the portion of the rear surface of the flying lead 28 which was not covered with the cover film 27. If the distance L was the same, the exposed portion tended to increase as the viscosity became high. In this embodiment, the distance L was set to 0.1 mm, and in the sealing process, a thermosetting sealant with a viscosity of 250 Pa·s was heated at 100° C. for about 1 hour.

Figure 5:
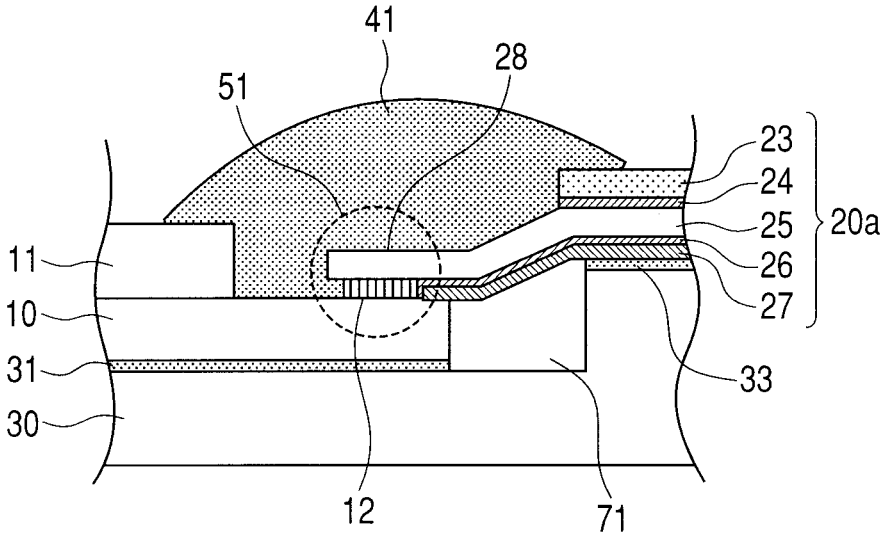
FIG. 5 is a view illustrating a state where the recording element and the cover film come into contact with each other.

In addition, the cover film 27, as illustrated in FIG. 5, may have a structure in which the cover film overhangs to a position where the cover film comes into contact with the recording element substrate 10. In this case, since the distance L becomes 0, the outflow of the sealant toward the rear surface of the flying lead 28 can be more reliably prevented.

In addition, although the configuration in which the sealant is dammed by the cover film 27 arranged on the downside (supporting member side) of the flying lead 25 is adopted in this embodiment, the invention is not limited thereto. For example, a configuration in which the sealant is dammed by the base film 23 arranged on the upside of the flying lead may be adopted. In this case, it is desirable to cover at least the downside of the flying lead with the cover film 27 so that the downside of the flying lead 25 is not exposed.

Figure 6A:
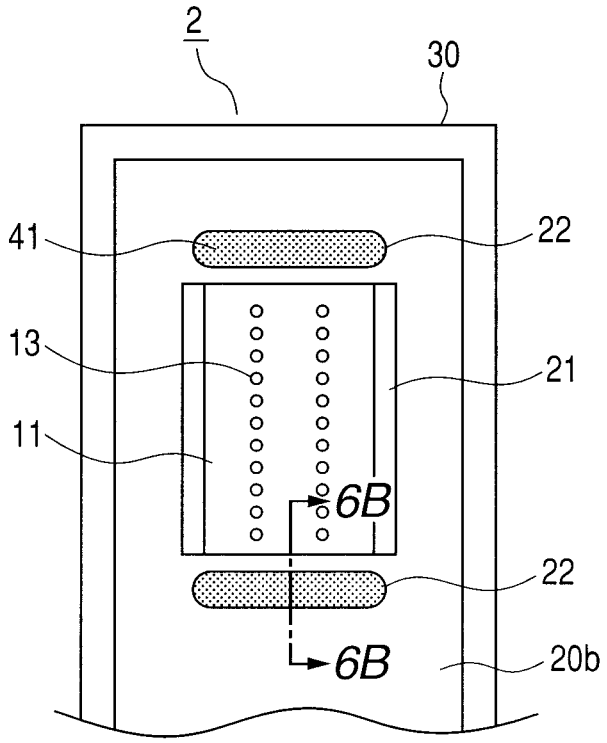
FIGS. 6A and 6B are views illustrating the configuration of essential parts of a liquid discharge recording head 2 of Embodiment 2.
Figure 6B:
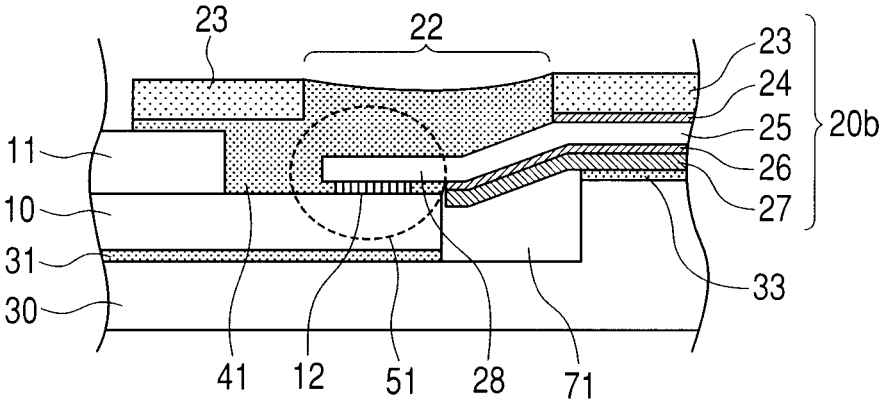
Figure 7A:
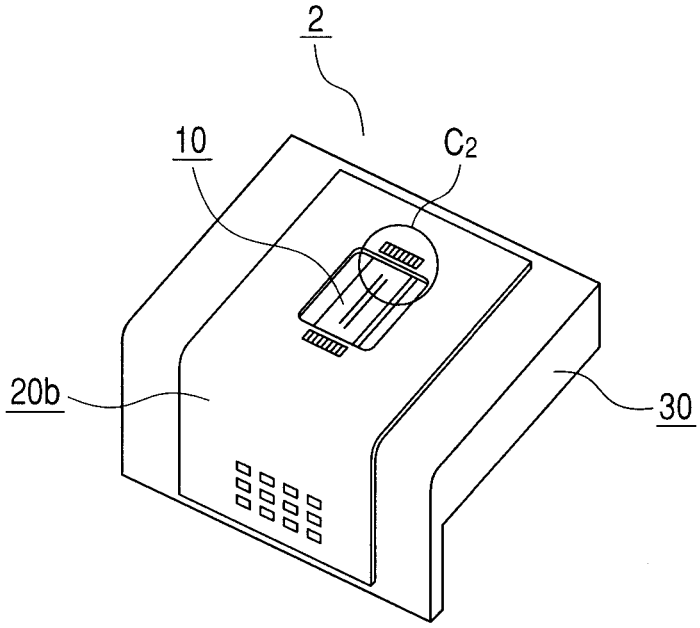
FIGS. 7A and 7B are views illustrating the configuration of the essential parts of the liquid discharge recording head 2 of Embodiment 2.
Figure 7B:
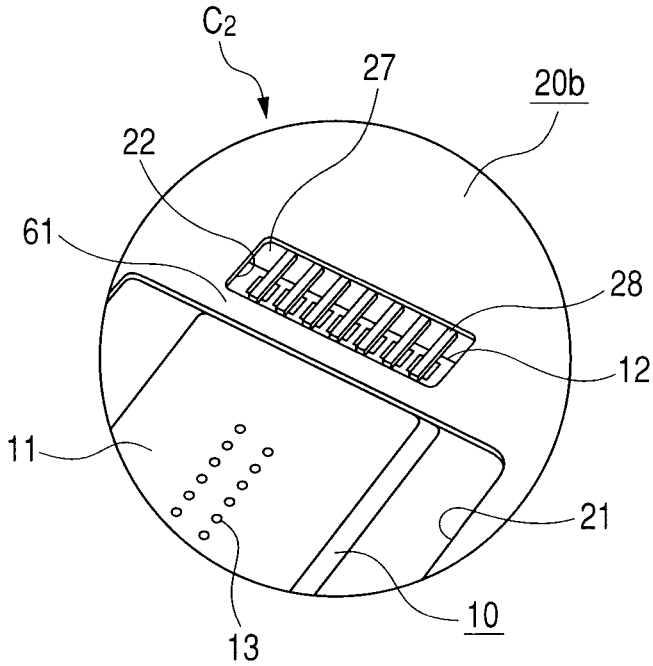
Figure 8A:
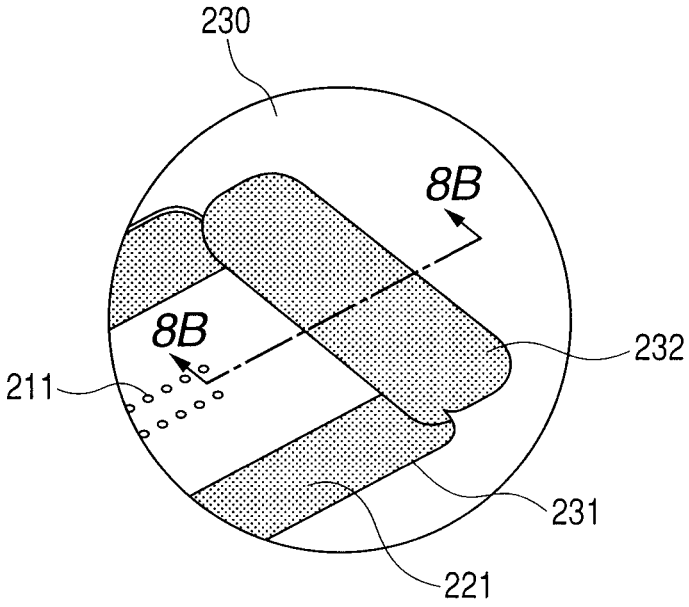
FIGS. 8A and 8B are views illustrating the configuration of a conventional liquid discharge recording head.
Figure 8B:
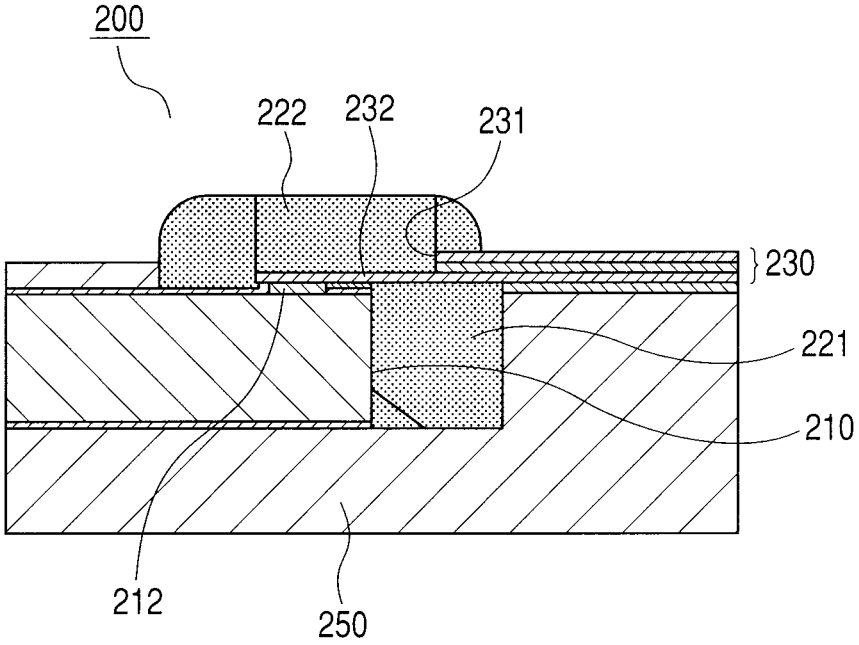
Figure 9A:
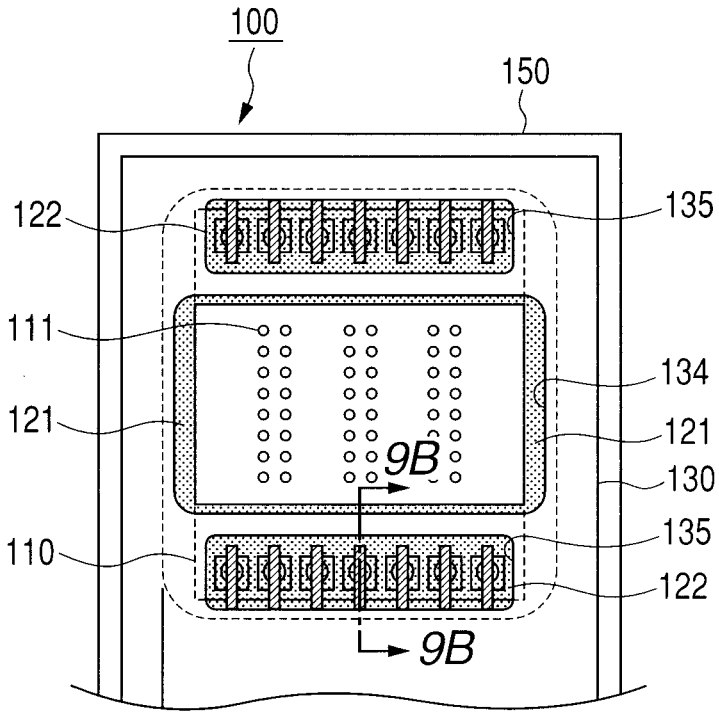
FIGS. 9A and 9B are views illustrating the configuration of a liquid discharge recording head described in Patent Document 2.
Figure 9B:
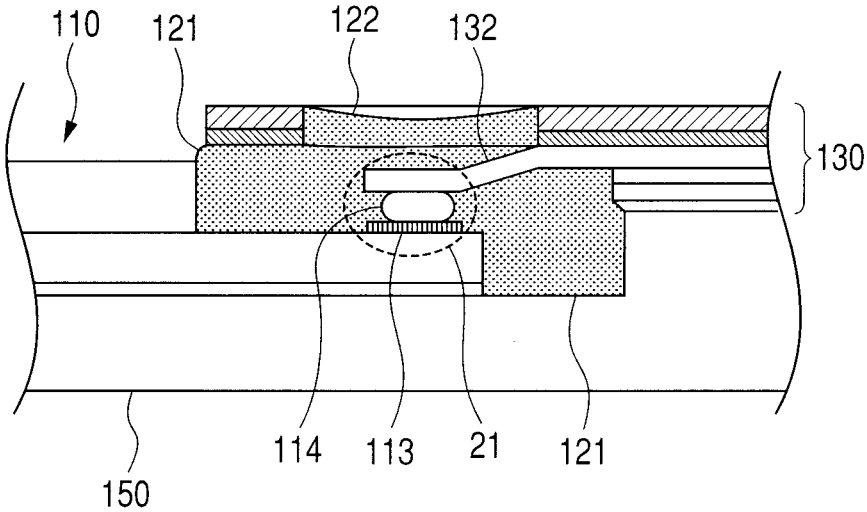

FIGS. 6A and 6B and FIGS. 7A and 7B are views illustrating the configuration of essential parts of a liquid discharge recording head of Embodiment 2. FIG. 6A is a plan view illustrating the configuration of essential parts of the liquid discharge recording head 2 of Embodiment 2, and FIG. 6B is a sectional view taken along a section line 6B-6B illustrated in FIG. 6A. Additionally, FIG. 7A is a perspective view of the liquid discharge recording head 2, and FIG. 7B is an enlarged view of a region C2 illustrated in FIG. 7A. Additionally, the same components as those of the above-described liquid discharge recording head 1 will be denoted by the same reference numerals, and detailed description thereof will be omitted.

In the liquid discharge recording head 2, the recording element substrate 10 and a flexible wiring member 20*b* are attached to the supporting member 30. Unlike the flexible wiring member 20*a*, in the flexible wiring member 20*b*, the device hole 21 and the bonding hole 22 are separated by a separating strip 61 and are independent from each other (refer to FIG. 7B). Additionally, the flexible wiring member 20*b* has the flying lead 28 and the cover film 27 similarly to the flexible wiring member 20*a*. The cover film 27 preferably has the structure in which the sealant 41 overhangs to either the position where the sealant does not flow out of the gap between the cover film 27 and the recording element substrate 10 or the position where the sealant comes into contact with the recording element substrate 10. Additionally, the slit 29 described in Embodiment 1 may be provided in the cover film 27. In this case, the sealant 41 needs to have such viscosity that the sealant does not flow out of the slit 29.

In the liquid discharge recording head 2, as illustrated in FIG. 6B, the sealant 41 is filled from the bonding hole 22 after the electrode portion 12 and the flying lead 28 are connected together. At this time, even in the liquid discharge recording head 2, it is not necessary to fill the void 71 with the sealant 41 in order to seal the electrical connection 51. Accordingly, in the liquid discharge recording head 2, it is possible to reliably perform sealing with a smaller amount of sealant than ever before.

Additionally, in the liquid discharge recording head 2, when the sealant 41 is applied, the sealant 41 can be dammed by the peripheral edge of the bonding hole 22 to prevent the outflow toward the device hole 21 (discharge ports 13) (refer to FIG. 6B). Therefore, it is possible to use sealant with low viscosity and high fluidity. Since the sealant can be filled in a short time as the fluidity of the sealant is higher, it is possible to shorten the time required for a sealing process.

Moreover, if the use of the sealant with low viscosity and large fluidity is allowed, as illustrated in FIG. 6B, since the sealing which makes the height of the sealant almost the same as that of the base film 23 is allowed, the quality of image recording improves.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-128789, filed May 28, 2009, which is hereby incorporated by reference herein in its entirety.

What is claimed is:

1. A liquid jet recording head comprising:

a recording element substrate provided with a discharge port through which a liquid droplet is discharged, and an electrode portion which receives a signal for controlling the discharge of the liquid droplet from the discharge port;

a flexible wiring member provided with an opening through which the recording element substrate is exposed, a flying lead which protrudes from the peripheral edge of the opening so as to be connected to the electrode portion and transmit the signal to the electrode portion, and a film which covers a portion of the flying lead;

a sealant which cover an electrical connection that is a connection between the electrode portion and the flying lead; and a supporting member to which the recording element substrate and the flexible wiring member are attached;

wherein the film overhangs along the extension direction of the flying lead to the recording element substrate from the peripheral edge of the opening so as to form a void between the side surface of the recording element substrate, and the supporting member, thereby partitioning the void from the electrical connection.

2. The liquid jet recording head according to claim 1, wherein, the opening includes a device hole through which the discharge port is exposed and a bonding hole through which the electrode portion is exposed, the flying lead protrudes from the peripheral edge of the bonding hole, and the film overhangs from the peripheral edge of the bonding hole.

3. The liquid jet recording head according to claim 2, wherein the device hole and the bonding hole are formed independently from each other.

4. The liquid jet recording head according to claim 1, wherein the film is not in contact with the recording element substrate, and overhangs to a position where the sealant is not allowed to flow out of between the recording element substrate and the film.

5. The liquid jet recording head according to claim 1, wherein the film overhangs to a position where the film comes into contact with the recording element substrate.

6. The liquid jet recording head according to claim 1, wherein a slit is formed along the flying lead in the film.

7. The liquid jet recording head according to claim 1, wherein a shape restoring force which works in a direction in which the connection of the electrical connection of the film is pulled apart is smaller than the joining force of the connection of the electrical connection.

* * * * *